US012678855B2

(12) United States Patent
Kimura et al.

(10) Patent No.: US 12,678,855 B2
(45) Date of Patent: Jul. 14, 2026

(54) CASTING DIE INSPECTION METHOD AND CASTING DEVICE

(71) Applicant: HONDA MOTOR CO., LTD., Tokyo (JP)

(72) Inventors: Satoru Kimura, Tokyo (JP); Kenji Yuki, Tokyo (JP); Ryo Onishi, Tokyo (JP); Masashi Fujikawa, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 80 days.

(21) Appl. No.: 18/284,557

(22) PCT Filed: Feb. 28, 2022

(86) PCT No.: PCT/JP2022/008129
§ 371 (c)(1),
(2) Date: Sep. 28, 2023

(87) PCT Pub. No.: WO2022/209504
PCT Pub. Date: Oct. 6, 2022

(65) Prior Publication Data

US 2024/0157434 A1 May 16, 2024

(30) Foreign Application Priority Data

Mar. 30, 2021 (JP) ..... 2021-057166

(51) Int. Cl.
*B22D 18/08* (2006.01)
*B22D 17/14* (2006.01)
(Continued)

(52) U.S. Cl.
CPC ..... *B22D 18/08* (2013.01); *B22D 17/14* (2013.01); *B22D 17/22* (2013.01); *B22D 17/32* (2013.01); *B22D 17/2227* (2013.01); *B22D 18/06* (2013.01)

(58) Field of Classification Search
CPC .... B22D 17/14; B22D 17/2227; B22D 17/32; B22D 18/06; B22D 18/08
See application file for complete search history.

(56) References Cited

U.S. PATENT DOCUMENTS 5,219,409 A 6/1993 Campbell et al.
5,979,536 A 11/1999 Iwamoto et al.
(Continued)

FOREIGN PATENT DOCUMENTS

CN 103357851 10/2013
CN 106994502 8/2017
(Continued)

OTHER PUBLICATIONS

Chinese Office Action and Search Report for Chinese Patent Application No. 202280025656.1 dated Sep. 18, 2025.
(Continued)

*Primary Examiner* — Keith Walker
*Assistant Examiner* — Jacky Yuen
(74) *Attorney, Agent, or Firm* — Amin, Turocy & Watson, LLP

(57) ABSTRACT

Provided are a casting die inspection method and a casting device, the method including: a step for acquiring the ultimate pressure in a cavity section, at the time when a prescribed vacuuming time has elapsed since evacuation the inside of the cavity section of the casting die was started; a step for evacuating the inside of the cavity section and acquiring an increased pressure in the cavity section that has increased during a prescribed stop time, at the time when the prescribed stop time has elapsed since the evacuation was stopped; a step for evaluating a first sealing property of the casting device on the basis of the ultimate pressure; and a step for evaluating a second sealing property of the casting device on the basis of the increased pressure.

8 Claims, 5 Drawing Sheets

(51) Int. Cl.

| | |
|---|---|
| ***B22D 17/22*** | (2006.01) |
| ***B22D 17/32*** | (2006.01) |
| ***B22D 18/06*** | (2006.01) |

(56) References Cited

U.S. PATENT DOCUMENTS

| | | | | |
|---|---|---|---|---|
| 6,148,902 | A * | 11/2000 | Zielinski | B22D 17/14 164/63 |
| 2013/0255901 | A1 | 10/2013 | Kim et al. | |
| 2017/0209920 | A1 | 7/2017 | Saida | |
| 2021/0379651 | A1 * | 12/2021 | Kawauchi | B22D 17/14 |

FOREIGN PATENT DOCUMENTS

| | | | | |
|---|---|---|---|---|
| EP | 1832362 | | 9/2007 | |
| JP | 53-137119 | | 10/1978 | |
| JP | 02-160155 | | 6/1990 | |
| JP | 06-015429 | | 1/1994 | |
| JP | 10-034309 | | 2/1998 | |
| JP | 2004-243327 | | 9/2004 | |
| JP | 2014-140878 | | 8/2014 | |
| WO | WO-2009067512 | A1 * | 5/2009 | B22D 17/14 |
| WO | WO-2020059113 | A1 * | 3/2020 | B22D 17/00 |

OTHER PUBLICATIONS

International Search Report and Written Opinion for International Application No. PCT/JP2022/008129 mailed on May 17, 2022, 9 pages.

* cited by examiner

CASTING DIE INSPECTION METHOD AND CASTING DEVICE

TECHNICAL FIELD

The present invention relates to a casting mold inspection method (casting die inspection method) and a casting device.

BACKGROUND ART

A vacuum casting system is known. In a vacuum casting system, a vacuum is drawn (gas is suctioned) in the inside of a cavity, and thereafter molten metal is injected into the cavity to perform casting. Due to this, the mixing of gas into the molten metal is restricted. As a result, it is possible to reduce the occurrence of defects (porosity, for example) in the cast product caused by gas.

Here, in order to reduce the defects in the cast product, it is preferable for the pressure inside the cavity to be low (high degree of vacuum) during the casting. That is, the casting device preferably has an excellent sealing property (little atmosphere leakage). However, the sealing material deteriorates as the casting is repeated, for example. As a result, there is a possibility that a sufficient pressure decrease in the cavity cannot be realized, due to a decrease in the sealing property of the casting device. Document of JP 2004-243327 A discloses technology for checking the sealing property of a casting mold. In this technology, a vacuum tank having a vacuum sensor is connected to the casting mold, and the degree of vacuum within the casting mold is measured using the vacuum sensor.

It should be noted that a certain amount of time is usually needed from when the vacuum drawing ends to when the casting starts (injection of the molten metal). Therefore, it is uncertain whether the pressure (degree of vacuum) at the time when the vacuum drawing ends is maintained at the time when the casting starts. That is, it is preferable to be able to inspect the sealing property of the casting device at timings even after the end of the vacuum drawing.

However, it is difficult to inspect the sealing property of the casting device at times after the end of the vacuum drawing when using the technology disclosed in the above Document. That is, after the vacuum drawing ends, the connection between the cavity portion and the vacuum drawing apparatus (the vacuum tank having the vacuum sensor in the above Document) is severed in preparation for the injection of the molten metal. Therefore, with the technology of the Document, it is not easy to measure the pressure (degree of vacuum) inside the cavity portion after the vacuum drawing ends.

SUMMARY OF THE INVENTION

As described above, there is a need to inspect the sealing property of a casting device even at timings after vacuum drawing ends. The present invention has the object of making it possible to inspect the sealing property of the casting device even at timings after vacuum drawing ends.

An inspection method of a casting device according to an aspect of the present invention is an inspection method of a casting device including a casting mold, wherein: the casting mold includes a cavity portion configured to create a cast product, a first gas flow path that includes a first end connected to the cavity portion, and a shut-off valve configured to shut off the first gas flow path; and the casting device includes a vacuum drawing portion configured to draw a vacuum inside the cavity portion, via the first gas flow path; and the inspection method including: acquiring an ultimate pressure inside the cavity portion at a timing when a prescribed vacuum drawing time has passed from when vacuum drawing inside the cavity portion was started; acquiring a pressure increase inside the cavity portion, which has occurred during a prescribed stoppage time, at a timing when the prescribed stoppage time has passed from when, after vacuum drawing inside the cavity portion, the vacuum drawing was stopped in a state of the shut-off valve being kept open; evaluating a first sealing property of the casting device based on the ultimate pressure; and evaluating a second sealing property of the casting device based on the pressure increase.

A casting device according to an aspect of the present invention is a casting device including a casting mold, wherein: the casting mold includes a cavity portion configured to create a cast product, a first gas flow path that includes a first end connected to the cavity portion, and a shut-off valve configured to shut off the first gas flow path; the casting device includes: a vacuum drawing portion configured to draw a vacuum inside the cavity portion, via the first gas flow path; and a control section configured to control the vacuum drawing portion and the shut-off valve; and the control section: acquires an ultimate pressure inside the cavity portion at a timing when a prescribed vacuum drawing time has passed from when vacuum drawing inside the cavity portion was started; acquires a pressure increase inside the cavity portion, which has occurred during a prescribed stoppage time, at a timing when the prescribed stoppage time has passed from when, after vacuum drawing inside the cavity portion, the vacuum drawing was stopped in a state of the shut-off valve being kept open; evaluates a first sealing property of the casting device based on the ultimate pressure; and evaluates a second sealing property of the casting device based on the pressure increase.

According to the present invention, it is possible to provide a casting mold inspection method and a casting device that make it possible to inspect the sealing property of the casting device even after vacuum drawing ends.

DETAILED DESCRIPTION OF THE INVENTION

The following describes a casting mold inspection method and a casting device according to embodiments of the present invention.

Figure 1:
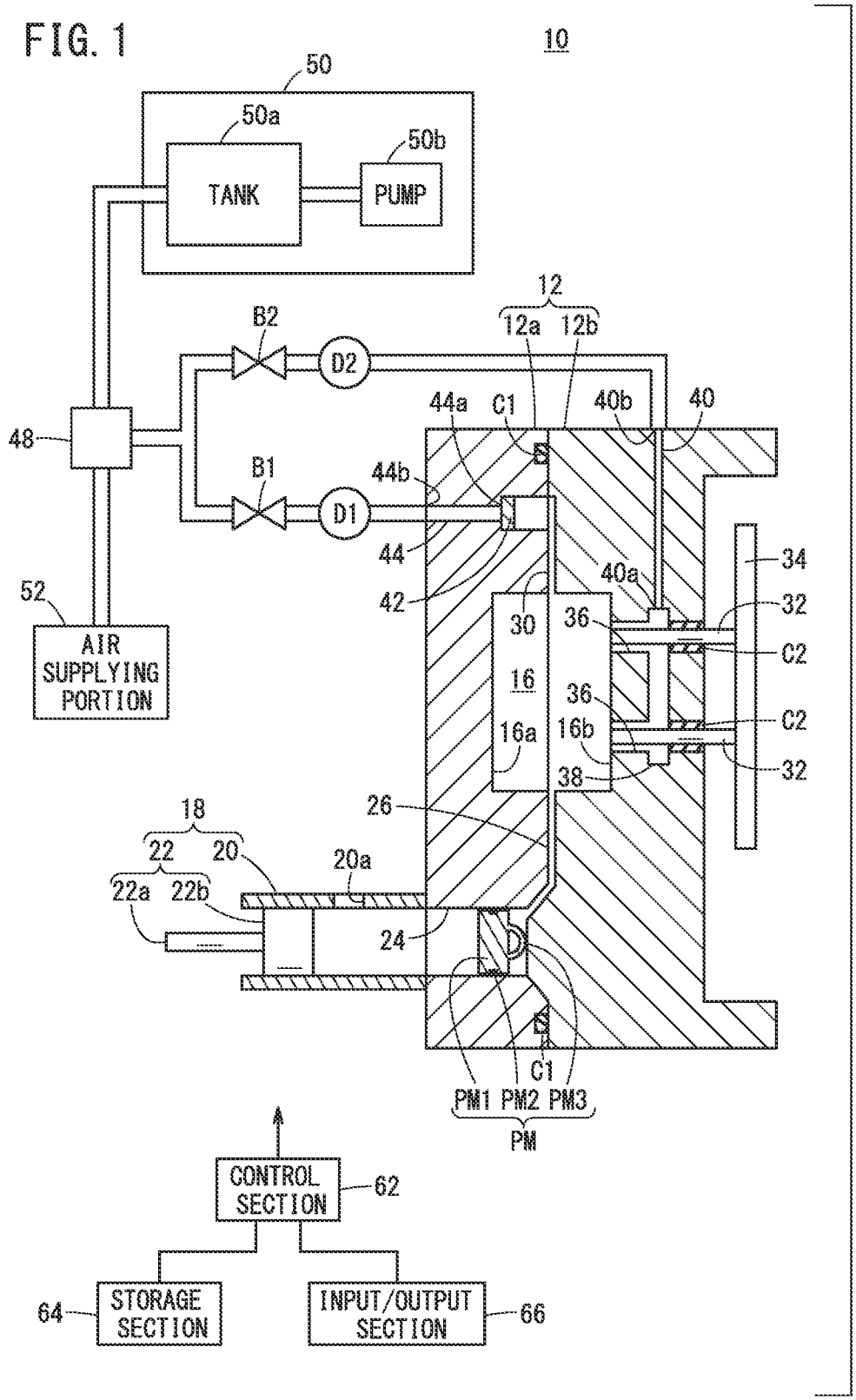
FIG. 1 is a diagram showing a casting device according to an embodiment.

A casting device 10 shown in FIG. 1 includes a casting mold 12. The casting mold 12 includes a fixed mold 12*a* and a movable mold 12*b*. The fixed mold 12*a* and the movable mold 12*b* are arranged along a right-left direction (horizontal direction) in the drawings, and face each other. The movable mold 12*b* moves in the horizontal direction in a manner to be able to come in contact with and move away from the fixed mold 12*a*. The fixed mold 12*a* and the movable mold 12*b* have a pair of mating surfaces that face each other. The mating surface of the fixed mold 12*a* and the mating surface of the movable mold 12*b* respectively include a recessed portion 16*a* and a recessed portion 16*b*. The recessed portion 16*a* and the recessed portion 16*b* form a cavity portion 16. By abutting the movable mold 12*b* against the fixed mold 12*a*, the casting mold 12 is closed. That is, the cavity portion 16 is formed inside the casting mold 12. A gap between the fixed mold 12*a* and the movable mold 12*b* is sealed by a sealing member C1 (an O-ring, for example).

A molten metal supplying portion 18 is connected to the casting mold 12. The molten metal supplying portion 18 is attached to the fixed mold 12*a*, and supplies molten metal to the inside of the cavity portion 16. The molten metal supplying portion 18 includes a sleeve 20 and a plunger 22. The plunger 22 includes a plunger rod 22*a* and a plunger tip 22*b*. The plunger tip 22*b* is arranged at an end portion of the plunger rod 22*a*, and reciprocates in an axial direction of the sleeve 20, within the sleeve 20. A molten metal injection port 20*a* is formed in a side surface of the sleeve 20. The molten metal injection port 20*a* is an injection port for injecting molten metal into the sleeve 20. The fixed mold 12*a* includes a molten metal holding portion 24 in communication with the inside of the sleeve 20. A molten metal path 26 is arranged between the fixed mold 12*a* and the movable mold 12*b*. The molten metal path 26 connects the molten metal holding portion 24 and the cavity portion 16. The plunger 22 is pressed after the molten metal is injected into the sleeve 20 through the molten metal injection port 20*a*. Due to this, the molten metal inside the sleeve 20 is supplied to the inside of the cavity portion 16, via the molten metal holding portion 24 and the molten metal path 26.

Here, atmosphere is prevented from flowing into the cavity portion 16 through the molten metal supplying portion 18, due to the molten metal holding portion 24 being filled with molten metal. Furthermore, when inspecting the casting mold 12, a plug member PM for sealing is inserted into the molten metal holding portion 24. Due to this, it is possible to sever the connection between the cavity portion 16 and the molten metal supplying portion 18 without using molten metal. As a result, the inspection of the sealing property of the casting device 10 becomes easy to perform. The plug member PM includes a pillar portion PM1, a sealing member PM2, and a handle PM3. The pillar portion PM1 has a pillar shape (cylindrical pillar or prismatic pillar, for example) corresponding to the inside of the molten metal holding portion 24. The sealing member PM2 is ring-shaped and arranged around the circumferential side surface of the molten metal holding portion 24. The sealing member PM2 is elastic, and seals the space between the inner circumferential surface of the molten metal holding portion 24 and the pillar portion PM1. The handle PM3 is used to insert the plug member PM into the molten metal supplying portion 18. After the fixed mold 12*a* and movable mold 12*b* have been moved away from each other, the plug member PM is inserted into the molten metal holding portion 24 in a direction from the movable mold 12*b* toward the fixed mold 12*a*.

The movable mold 12*b* includes an overflow portion 30 that is downstream from the cavity portion 16. The molten metal supplied to the cavity portion 16 reaches the overflow portion 30, and then hardens inside the cavity portion 16 and overflow portion 30. The molten metal that has hardened is removed from the casting mold 12 as a cast product.

In order to facilitate the removing of the cast product from the cavity portion 16, an ejector pin 32 and an ejector plate 34 are attached to the movable mold 12*b*. The movable mold 12*b* includes a through-hole 36 that is in communication with the cavity portion 16 and the outside of the casting mold 12. The ejector pin 32 is held inside the through-hole 36. One end of the ejector pin 32 is connected to the ejector plate 34. By pressing the ejector plate 34 toward the fixed mold 12*a*, the other end of the ejector pin 32 is inserted into the cavity portion 16. As a result, the cast product can be easily taken out from the cavity portion 16.

An internal space 38 and a gas flow path 40 are formed inside the movable mold 12*b*. The internal space 38 is in communication with the through-hole 36. The gas flow path 40 is connected to the internal space 38. A sealing member C2 is arranged inside the through-hole 36 outside the internal space 38. The sealing member C2 seals the space between the through-hole 36 and the ejector pin 32. The sealing member C2 seals a region between an end portion 40*a* of the gas flow path 40 and the outside, in this space. The internal space 38, the gas flow path 40, and the sealing member C2 each obstruct atmosphere from flowing into the cavity portion 16 via the gap between the through-hole 36 and the ejector pin 32. That is, the sealing member C2 obstructs atmosphere from flowing into the cavity portion 16 via the gap between the through-hole 36 and the ejector pin 32, by sealing the space between the through-hole 36 and the ejector pin 32. However, in order for the ejector pin 32 to operate, the ejector pin 32 must slide relative to the through-hole 36, and therefore there is a limit on the sealing provided by the sealing member C2. Therefore, suction is exerted inside the through-hole 36 between the internal space 38 and the cavity portion 16, via the internal space 38 and the gas flow path 40. This suction reduces the inflow of atmosphere into the cavity portion 16 through the through-hole 36 in which the sealing member C2 is arranged.

The casting mold 12 includes a shut-off valve 42 and a gas flow path 44. The shut-off valve 42 is arranged between the overflow portion 30 and the gas flow path 44. The shut-off valve 42 blocks the intrusion of molten metal from the overflow portion 30 into the gas flow path 44, by shutting off the gas flow path 44.

The gas flow path 44 includes an end portion 44*a* (first end) and an end portion 44*b* (third end) on opposite sides thereof. The end portion 44*a* is connected to the cavity portion 16 via the shut-off valve 42. The end portion 44*b* is connected to a vacuum drawing portion 50 via a pressure detector D1, a valve B1, and a switch valve 48. The vacuum drawing portion 50 draws a vacuum (suctions gas from) inside the cavity portion 16, via the gas flow path 44 and the overflow portion 30. The vacuum drawing portion 50 includes a tank 50*a* and a vacuum pump 50*b*. The vacuum drawing portion 50 draws a vacuum inside the cavity portion 16 by the tank 50*a* being depressurized by the vacuum pump 50*b*.

The gas flow path 40 includes an end portion 40*a* (second end) and an end portion 40*b* (fourth end) on opposite sides thereof. The end portion 40*a* is connected to the cavity portion 16 via the internal space 38. The end portion 40*b* is connected to the vacuum drawing portion 50 via a pressure detector D2, a valve B2, and the switch valve 48. The vacuum drawing portion 50 draws a vacuum inside the cavity portion 16, via the gas flow path 40 and the gap between the through-hole 36 and the ejector pin 32 as well. That is, the vacuum drawing portion 50 can draw the vacuum inside the cavity portion 16 through both the gas flow path 44 and the gas flow path 40.

An air supplying portion 52 is connected to the switch valve 48, along with the vacuum drawing portion 50. The air supplying portion 52 causes air to flow (blows air) into the open casting mold 12, via the switch valve 48, the gas flow path 44, and the overflow portion 30. Air is supplied from the air supplying portion 52 to the end portion 44*b* (third end) of the gas flow path 44. Due to this, the gas flow path 44, the shut-off valve 42, and the like are cleaned. The switch valve 48 switches the connection between the gas flow path 44 and the vacuum drawing portion 50 and the connection between the gas flow path 44 and the air supplying portion 52.

The pressure detector D1 and the valve B1 are arranged between the gas flow path 44 and the switch valve 48. The valve B1 is a gate valve that switches between connection and disconnection, between the gas flow path 44 and the vacuum drawing portion 50 (or the air supplying portion 52). The pressure detector D1 measures the pressure P at the third end (end portion 44*b*) of the gas flow path 44. The pressure detector D2 and the valve B2 are arranged between the gas flow path 40 and the switch valve 48. The valve B2 is a gate valve that switches between connection and disconnection, between the gas flow path 40 and the vacuum drawing portion 50 (or air supplying portion 52). The pressure detector D2 measures the pressure P at the fourth end (end portion 40*b*) of the gas flow path 40.

The casting device 10 includes a control section 62, a storage section 64, and an input/output section 66. The casting device 10 inspects the sealing property of the casting device 10. The control section 62 is formed by hardware (a processor, for example) and software (a program, for example). The control section 62 controls the molten metal supplying portion 18, the shut-off valve 42, the switch valve 48, the valve B1, the valve B2, the vacuum drawing portion 50, and the air supplying portion 52. The control section 62 receives signals from the pressure detector D1 and the pressure detector D2. The storage section 64 is a hard disk or a semiconductor memory, for example. The storage section 64 stores vacuum drawing times T1*a* and T1*b*, a stop time T2, a first threshold value Th1, a second threshold value Th2, and a third threshold value Th3, which are described further below. The input/output section 66 is a device that inputs and outputs information between the control section 62 and an operator. The input/output section 66 is a keyboard and a display device, for example.

Figure 2:
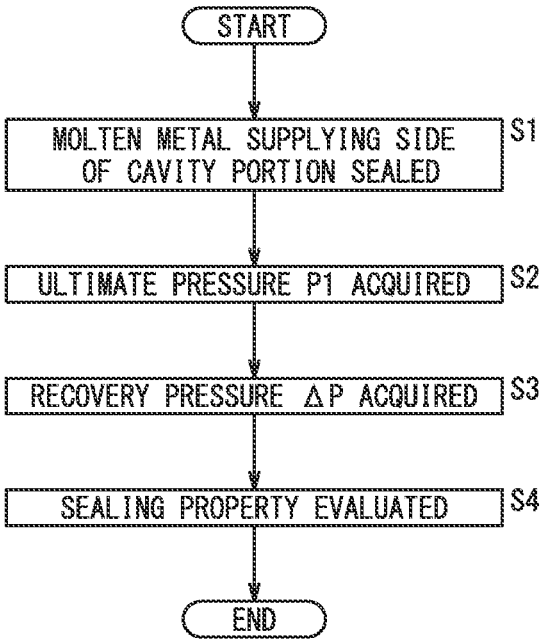
FIG. 2 is a flow chart showing an inspection method by the casting device according to an embodiment.
Figure 3:
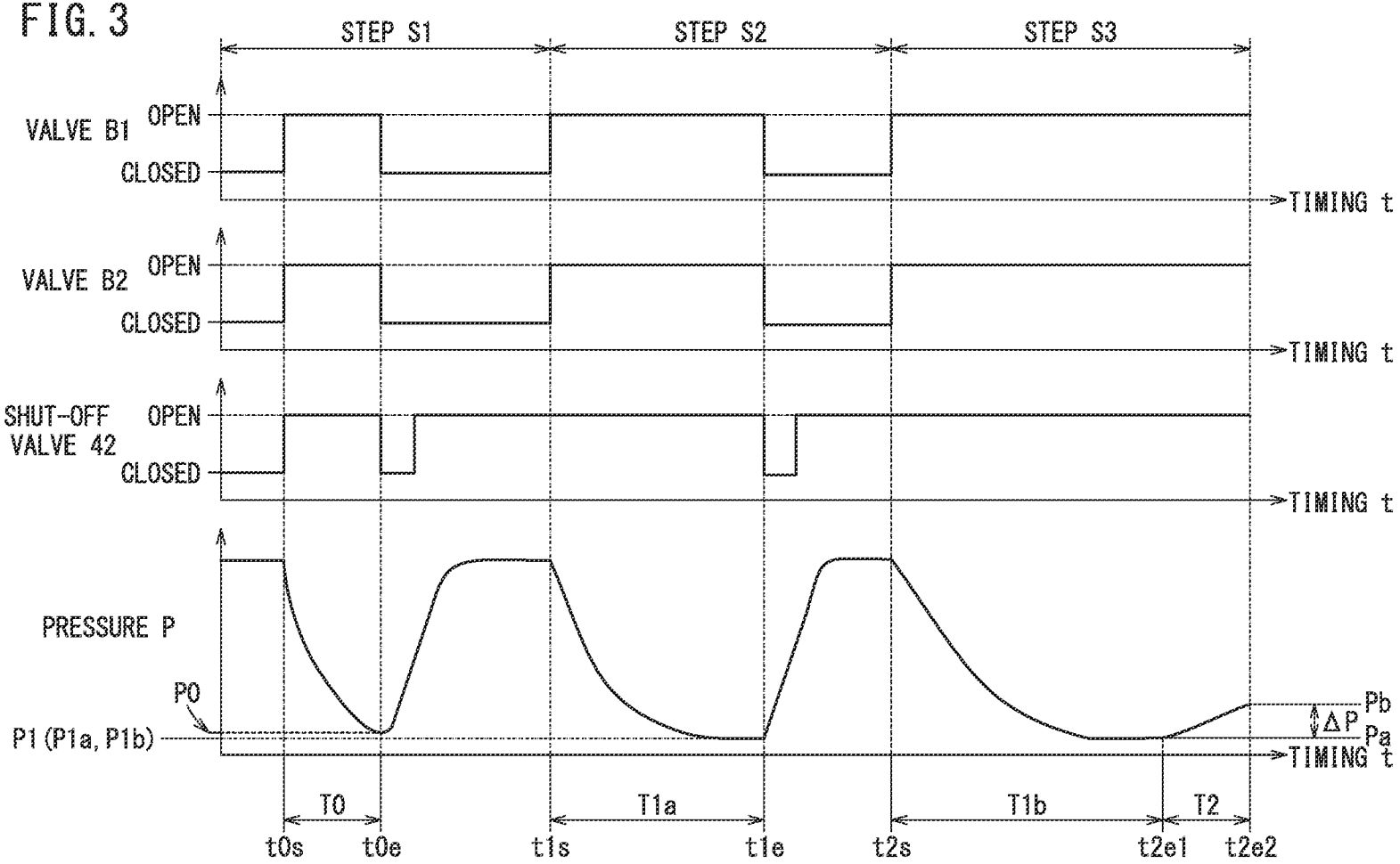
FIG. 3 is a chart showing a change over time of valves, the opening and closing of shut-off valves, and pressure.

FIG. 2 is a flow chart showing an inspection method of the casting device 10 according to the present embodiment. FIG. 3 shows the change over time of the opening and closing of the valve B1 and the valve B2, the change over time of the opening and closing of the shut-off valve 42, and the change over time of the pressures P. The following describes an inspection method of the casting device 10 according to the present embodiment, based on FIGS. 2 and 3.

The casting device 10 inspection method includes a step of sealing the space between the cavity portion 16 and the molten metal supplying portion 18 (step S1). As described above, the space between the cavity portion 16 and the molten metal supplying portion 18 is sealed by inserting the plug member PM for sealing into the molten metal holding portion 24, without using molten metal. That is, after the casting mold 12 is opened, the plug member PM is inserted into the molten metal holding portion 24 in the direction from the movable mold 12*b* toward the fixed mold 12*a*, and thereafter the casting mold 12 is closed.

Here, after the casting mold 12 has been closed, a vacuum is preferably drawn in the cavity portion 16 in order to fix the position of the plug member PM. As shown in FIG. 3, the control section 62 controls the valve B1, the valve B2, and the shut-off valve 42 to keep the valve B1, the valve B2, and the shut-off valve 42 open during the time period T0 (from the timing t0*s* to the timing t0*e*), thereby drawing the vacuum in the cavity portion 16. Due to this vacuum drawing, the plug member PM moves inside the molten metal holding portion 24 in a direction from the fixed mold 12*a* toward the movable mold 12*b*, thereby abutting against a portion of the movable mold 12*b* (see FIG. 1) that is exposed to the molten metal holding portion 24. This exposed portion of the movable mold 12*b* functions as a bottom of the molten metal holding portion 24 that defines the internal space of the molten metal holding portion 24. Here, the plug member PM abutting against the movable mold 12*b* means that the position of the plug member PM is fixed. Due to this, as described further below, the accuracy of the correction of the pressure can be improved. The time period T0 for the vacuum drawing may be shorter than the time period T1*a* for the vacuum drawing for acquiring the ultimate pressure P1, which is described further below. Furthermore, this vacuum drawing is performed to move the plug member PM, and thus the degree of vacuum inside the cavity portion 16 does not have to be particularly high. That is, the pressure inside the cavity portion 16 only has to be less than a pressure P0 (see FIG. 3) that is a prescribed pressure difference (negative pressure) relative to the atmospheric pressure.

The following describes the correction of the pressure P. The internal volume Vm of the molten metal holding portion 24 at the time of the sealing by the plug member PM differs from the internal volume Vc of the molten metal holding portion 24 at the time of the sealing by the molten metal (time of casting). Specifically, the internal volume Vm is ΔV greater than the internal volume Vc (Vm−Vc=ΔV). Therefore, the correction shown in Equation (1) is performed to make the pressure Pm measured at the time of the sealing by the plug member PM match the pressure Pc at the time of casting (that is, the time of the start of injection of molten metal).

$$Pc=A\cdot Pm \tag{1}$$

$$A=(V0+Vm)/(V0+Vc)$$

V0: internal volume of the casting mold 12 excluding the molten metal holding portion 24

Figure 4:
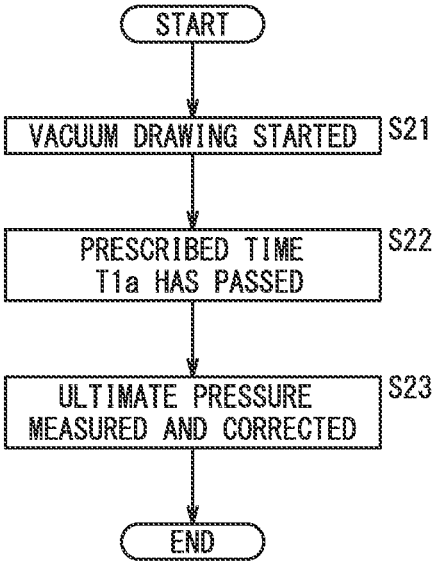
FIG. 4 is a flow chart showing the details of a process of acquiring an ultimate pressure.

Returning to FIG. 2, the following will describe the inspection process. The inspection method of the casting device 10 includes a step (step S2) of acquiring the ultimate pressure P1 inside the cavity portion 16, after the space between the cavity portion 16 and the molten metal supplying portion 18 has been sealed. FIG. 4 is a flow chart showing the details of the process of acquiring the ultimate pressure P1. As shown in FIG. 4, the ultimate pressure P1 can be acquired in the following manner. First, the vacuum drawing inside the cavity portion 16 is started (step S21). After this, the ultimate pressure P1 inside the cavity portion 16, at a timing when a prescribed vacuum drawing time T1*a* has passed from when the vacuum drawing inside the cavity portion 16 was started, is acquired (steps S22 and S23).

Specifically, the control section 62 controls the shut-off valve 42, the vacuum drawing portion 50, the valve B1, and the valve B2 to open both the valve B1 and the valve B2 while the shut-off valve 42 is open, at the timing t1*s*, as shown in FIG. 3. Due to this, the control section 62 starts the vacuum drawing inside the cavity portion 16 through both the gas flow path 44 (first gas flow path) and the gas flow path 40 (second gas flow path) (step S21).

After this, the control section 62 acquires the ultimate pressure P1*a* at a timing (timing t1*e*) when the prescribed vacuum drawing time T1*a* has passed from when the vacuum drawing was started (steps S22 and S23). The ultimate pressure P1*a* is based on the pressure at the end portion 44*b* of the gas flow path 44 acquired from the pressure detector D1. The average vacuum drawing time during casting can be used as the prescribed vacuum drawing time T1*a*. The measured ultimate pressure P1*a* can be corrected by multiplying the ultimate pressure P1*a* by the coefficient A shown in Equation (1).

The control section 62 can use a second ultimate pressure P1*b* measured by the pressure detector D2 as the ultimate pressure P1 as well. That is, the control section 62 acquires the second ultimate pressure P1*b* based on the pressure measured by the pressure detector D2 at the timing when the prescribed vacuum drawing time T1*a* has passed from when the vacuum drawing started. The pressure detector D2 measures the pressure at the end portion 40*b* of the gas flow path 40. The measured second ultimate pressure P1*b* can be corrected by multiplying the second ultimate pressure P1*b* by the coefficient A shown in Equation (1). By using both the pressure detector D1 and the pressure detector D2, it is possible to more reliably evaluate a first sealing property of the casting mold 12.

The casting device 10 inspection method includes a step (step S3) of acquiring a recovery pressure ΔP inside the cavity portion 16. After the inside of the cavity portion 16 has reached a constant ultimate pressure P1 due to the vacuum drawing, the control section 62 stops the vacuum drawing. The recovery pressure ΔP refers to the pressure increase that occurs within the stoppage time.

Figure 5:
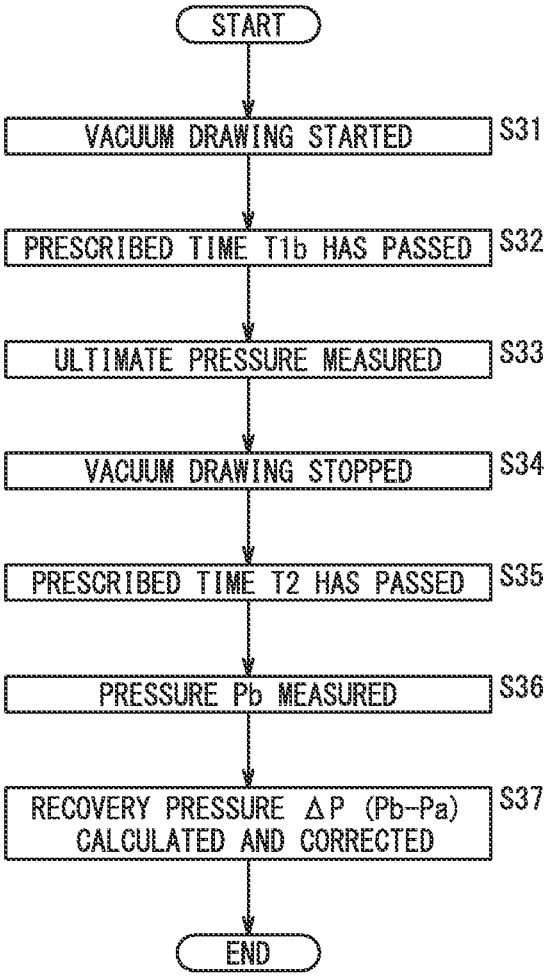
FIG. 5 is a flow chart showing the details of a process of acquiring a recovery pressure.

FIG. 5 is a flow chart expressing the details of the process of acquiring the recovery pressure ΔP. As shown in FIG. 5, the recovery pressure ΔP can be acquired in the following manner. Specifically, in a similar manner as when acquiring the ultimate pressure P1, the control section 62 opens both the valve B1 and the valve B2 at the timing t2*s*, as shown in FIG. 3. Due to this, the control section 62 starts the vacuum drawing inside the cavity portion 16 (step S31). After this, the control section 62 acquires a first pressure Pa inside the cavity portion 16 at a timing (timing t2*e*1) when a prescribed vacuum drawing time T1*b* has passed from when the vacuum drawing started (steps S32 and S33).

Next, the control section 62 stops the vacuum drawing inside the cavity portion 16 at the timing (timing t2*e*1), that is, the prescribed vacuum drawing time T1*b* after when the vacuum drawing started (step S34). The control section 62 acquires the second pressure Pb inside the cavity portion 16 at a timing (timing t2*e*2), that is, when a prescribed stoppage time T2 has passed from when the vacuum drawing inside the cavity portion 16 stopped (steps S35 and S36). An average time during the casting such as described in the following can be used as the prescribed stoppage time T2. This average time refers to the average time from when the vacuum drawing ends to when the injection of molten metal from the molten metal supplying portion 18 to the cavity portion 16 is started. The control section 62 can acquire the recovery pressure ΔP (=Pb−Pa) by subtracting the first pressure Pa from the second pressure Pb (step S37). The recovery pressure ΔP can be corrected by multiplying the recovery pressure ΔP obtained from the subtraction by the coefficient A shown in Equation (1) (step S37). Due to this, it is possible to estimate the pressure P inside the cavity portion 16 at the timing when the molten metal is injected. Basically, it is possible to calculate the pressure P (P=P1+ΔP) inside the cavity portion 16 at the timing when the molten metal is injected, by adding together the recovery pressure ΔP and the ultimate pressure P1.

Here, in step S34 (timing t2*e*1), the control section 62 closes the valve B1 and the valve B2 to stop the vacuum drawing through the gas flow paths 44 and 40. On the other hand, the control section 62 keeps the shut-off valve 42 open. This is because the pressure detector D1 measures the pressure at the end portion 44*b* of the gas flow path 44 (that is, the pressure inside the cavity portion 16).

Here, the prescribed vacuum drawing time T1*b* in step S32 at the timing of acquiring the recovery pressure ΔP is preferably longer than the prescribed vacuum drawing time T1*a* in step S22 at the timing of acquiring the ultimate pressure P1. Due to this, it is possible to stabilize the first pressure Pa that has been reached. As a result, it is possible to reduce the error in the recovery pressure ΔP that is caused by the recovery pressure ΔP being dependent on the ultimate pressure P1.

Here, steps S34 to S37 for acquiring the recovery pressure ΔP may be started at the timing t1*e* (immediately after the acquisition of the ultimate pressure P1), instead of at the timing t2*e*1. In such a case, the steps S31 to S34 can be omitted. This is because the steps S31 to S33 are repetitions of steps substantially the same as steps S21 to S23. Due to this, it is possible to acquire the recovery pressure ΔP more easily.

The control section 62 evaluates the sealing property of the casting device 10 (step S4). This sealing property includes a first sealing property that is based on the ultimate pressure P1 and a second sealing property that is based on the recovery pressure ΔP.

The first sealing property refers to the sealing property of the overall casting device 10, including the casting device 10 itself, the pipes of the casting device 10, and the casting mold 12. The first sealing property is evaluated based on the ultimate pressure P1. That is, the control section 62 can judge the first sealing property to be good when the ultimate pressure P1*a* is less than or equal to a first threshold value Th1. The ultimate pressure P1*a* is based on the measurement result from the pressure detector D1 (gas flow path 44). Furthermore, the control section 62 can judge the first sealing property to be poor when the ultimate pressure P1*a* is greater than the first threshold value Th1.

Alternatively, the control section 62 may evaluate the first sealing property by using both the ultimate pressure P1*a* and the second ultimate pressure P1*b*. The ultimate pressure P1*a* is based on the measurement result from the pressure detector D1 (gas flow path 44). The second ultimate pressure P1*b* is based on the measurement result from the pressure detector D2 (gas flow path 40). Specifically, the control section 62 may judge the first sealing property to be good when the ultimate pressure P1*a* is less than or equal to the first threshold value Th1 and the second ultimate pressure P1*b* is less than or equal to a third threshold value Th3. The control section 62 may judge the first sealing property to be poor when the ultimate pressure P1*a*is greater than the first threshold value Th1 or the second ultimate pressure P1*b* is greater than the third threshold value Th3. In this way, the reliability of the evaluation of the first sealing property is improved.

The control section 62 evaluates the second sealing property of the casting device 10, based on the recovery pressure ΔP. It can be said that the second sealing property refers to the sealing property of the casting mold 12. By using the second sealing property along with the first sealing property, it is possible to more reliably evaluate the sealing property of the casting device 10. The control section 62 can judge the second sealing property to be good when the recovery pressure ΔP is less than or equal to the second threshold value Th2. The control section 62 can judge the second sealing property to be poor when the recovery pressure ΔP is greater than the second threshold value Th2. Furthermore, the pressure (degree of vacuum) inside the cavity portion 16 at the time of casting (time when the molten metal is injected) can be estimated by adding the recovery pressure ΔP to the ultimate pressure P1*a*.

The control section 62 displays the acquired ultimate pressures P1 (P1*a* and P1*b*), the recovery pressure ΔP, and the evaluation result of the sealing property in the input/output section 66. Based on this evaluation result, the sealing members of the casting device 10 and the casting mold 12 are replaced, and casting by the casting device 10 is performed.

Invention Understandable from the Embodiment

The following is a record of the invention that can be understood from each embodiment described above.

(1) The inspection method of the casting device (10) including the casting mold (12), wherein: the casting mold includes the cavity portion (16) for creating the cast product, the first gas flow path (44) that has the first end (44*a*) connected to the cavity portion, and the shut-off valve (42) configured to shut off the first gas flow path; and the casting device includes the vacuum drawing portion (50) for drawing a vacuum inside the cavity portion, via the first gas flow path, the inspection method including: the step (step S2) of acquiring the ultimate pressure (P1*a*) inside the cavity portion at a timing when the prescribed vacuum drawing time (T1*a*) has passed from when the vacuum drawing inside the cavity portion was started; the step (step S3) of acquiring the pressure increase (recovery pressure ΔP) inside the cavity portion, which has occurred during the prescribed stoppage time (T2), at a timing when the prescribed stoppage time has passed from when, after vacuum drawing inside the cavity portion, the vacuum drawing was stopped in a state of the shut-off valve being kept open; the step (step S4) of evaluating the first sealing property of the casting device based on the ultimate pressure; and the step (step S4) of evaluating the second sealing property of the casting device based on the pressure increase. Due to this, it is possible to inspect the sealing property of the casting device even after the vacuum drawing ends, by using both the ultimate pressure and the pressure increase.

(2) The step of evaluating the first sealing property includes the step of judging the first sealing property to be good when the ultimate pressure is less than or equal to the first threshold value (Th1) and judging the first sealing property to be poor when the ultimate pressure is greater than the first threshold value. Due to this, it is possible to perform a precise evaluation of the first sealing property.

(3) The step of evaluating the second sealing property includes the step of judging the second sealing property to be good when the pressure increase is less than or equal to the second threshold value (Th2) and judging the second sealing property to be poor when the pressure increase is greater than the second threshold value. Due to this, it is possible to perform a precise evaluation of the second sealing property.

(4) The step of acquiring the ultimate pressure includes: the step (step S21) of starting the vacuum drawing inside the cavity portion; and the step (steps S22, S23) of acquiring the ultimate pressure inside the cavity portion at a timing when the prescribed vacuum drawing time has passed from when the vacuum drawing inside the cavity portion was started; and the step of acquiring the pressure increase includes: the step (step S31) of starting the vacuum drawing inside the cavity portion; the step (steps S32, S33) of acquiring the first pressure (Pa) inside the cavity portion at a timing when the second prescribed vacuum drawing time, which is longer than the prescribed vacuum drawing time, has passed from when the vacuum drawing inside the cavity portion was started; the step (step S34) of stopping the vacuum drawing inside the cavity portion; the step (steps S35, S36) of acquiring the second pressure inside the cavity portion at a timing when the prescribed stoppage time has passed from when the vacuum drawing inside the cavity portion was stopped; and the step (step S37) of obtaining the pressure increase by subtracting the first pressure from the second pressure. Due to this, it is possible to accurately acquire the ultimate pressure and the pressure increase. Furthermore, by making the prescribed vacuum drawing time when acquiring the pressure increase longer than the prescribed vacuum drawing time when acquiring the ultimate pressure, the first pressure reached according to the prescribed vacuum drawing time used when acquiring the pressure increase can be stabilized, thereby making it possible to reduce the error in the pressure increase.

(5) The casting mold includes the molten metal holding portion (24) for holding molten metal to be injected into the cavity portion; the inspection method includes the step (step S1) of sealing the inside of the cavity portion from the outside by inserting the plug member (PM) for air-tight sealing into the molten metal holding portion, performed before the step of acquiring the ultimate pressure; the step of acquiring the ultimate pressure includes the step (step S23) of correcting the ultimate pressure based on a difference in internal volume (V1, V2) of the molten metal holding portion, the internal volume communicating with the cavity portion, between a timing at which the plug member has been inserted into the molten metal holding portion and a timing at which injection of molten metal into the cavity portion is started without the plug member being inserted into the molten metal holding portion; and the step of acquiring the pressure increase includes the step (step S37) of correcting the pressure increase based on the difference in internal volume. Due to this, it is possible to acquire the ultimate pressure and pressure increase corresponding to those occurring at the casting time, with high accuracy, without injecting the molten metal.

(6) The step of sealing the inside of the cavity portion from the outside includes the step of, after the plug member has been inserted into the molten metal holding portion, drawing a vacuum inside the cavity portion for a time (T0) shorter than the prescribed vacuum drawing time, and thereby causing the plug member to abut against the bottom of the molten metal holding portion. Due to this, the plug member is positionally fixed due to the vacuum drawing performed in a relatively short time, and thus it is possible to ensure the reliability of the corrections of the ultimate pressure and pressure increase.

(7) The casting mold includes: the through-hole (36) that is formed to allow the cavity portion and the outside of the casting mold to communicate with each other and holds the ejector pin (32) for ejecting the cast product from the cavity portion; the second gas flow path (40) that is formed inside the casting mold and has the second end (40*a*) connected to the space (internal space 38) between the through-hole and the ejector pin; and the sealing member (C2) that seals the region between the second end of the second gas flow path and the outside, in the space between the through-hole and the ejector pin; the vacuum drawing portion draws a vacuum inside the cavity portion, via both the first gas flow path and the second gas flow path; the step of acquiring the ultimate pressure includes: the step of starting the vacuum drawing inside the cavity portion via both the first gas flow path and the second gas flow path, with the shut-off valve being in an open state; and the step of acquiring the ultimate pressure based on pressure at the third end (44*b*) of the first gas flow path, which is on an opposite side from the first end; and the step of acquiring the pressure increase includes: the step of stopping the vacuum drawing via the first gas flow path and the second gas flow path, with the shut-off valve being in an open state; and the step of acquiring the pressure increase based on pressure at the third end of the first gas flow path with the shut-off valve being in the open state. Due to this, it is possible to accurately acquire the ultimate pressure and pressure increase at the timing when vacuum drawing is performed inside the cavity portion via both the first gas flow path and the second gas flow path.

(8) The step of acquiring the ultimate pressure includes the step of acquiring the second ultimate pressure at the fourth end (40*b*) of the second gas flow path, which is on an opposite side from the second end, at a timing when the prescribed vacuum drawing time has passed from when the vacuum drawing started; and the step of evaluating the first sealing property includes the step of judging the first sealing property to be good when the ultimate pressure is less than or equal to the first threshold value and the second ultimate pressure is less than or equal to the third threshold value (Th3), and judging the first sealing property to be poor when the ultimate pressure is greater than the first threshold value or the second ultimate pressure is greater than the third threshold value. Due to this, the first sealing property can be more accurately evaluated by using both the ultimate pressure in the first gas flow path and the second ultimate pressure in the second gas flow path.

(9) The casting device includes the casting mold, wherein: the casting mold includes the cavity portion for creating the cast product, the first gas flow path that has the first end connected to the cavity portion, and the shut-off valve configured to shut off the first gas flow path; the casting device includes: the vacuum drawing portion for drawing a vacuum inside the cavity portion, via the first gas flow path; and the control section (62) that controls the vacuum drawing portion and the shut-off valve; and the control section: acquires the ultimate pressure inside the cavity portion at a timing when the prescribed vacuum time has passed from when the vacuum drawing inside the cavity portion was started; acquires the pressure increase inside the cavity, which has occurred during the prescribed stoppage time, at a timing when the prescribed stoppage time has passed from when, after vacuum drawing inside the cavity portion, the vacuum drawing was stopped in a state of the shut-off valve being kept open; evaluates the first sealing property of the casting device based on the ultimate pressure; and evaluates the second sealing property of the casting device based on the pressure increase. Due to this, it is possible to inspect the sealing property of the casting device even after the vacuum drawing ends, by using both the ultimate pressure and the pressure increase.

(10) In the evaluation of the first sealing property, the control section judges the first sealing property to be good when the ultimate pressure is less than or equal to the first threshold value and judges the first sealing property to be poor when the ultimate pressure is greater than the first threshold value. Due to this, it is possible to perform a precise evaluation of the first sealing property.

(11) In the evaluation of the second sealing property, the control section judges the second sealing property to be good when the pressure increase is less than or equal to the second threshold value and judges the second sealing property to be poor when the pressure increase is greater than the second threshold value. Due to this, it is possible to perform a precise evaluation of the second sealing property.

(12) In the acquisition of the ultimate pressure, the control section: controls the vacuum drawing portion to start the vacuum drawing inside the cavity portion; and acquires the ultimate pressure inside the cavity portion at a timing when the prescribed vacuum drawing time has passed from when the vacuum drawing inside the cavity portion was started; and in the acquisition of the pressure increase, the control section: controls the vacuum drawing portion to start the vacuum drawing inside the cavity portion; acquires the first pressure inside the cavity portion at a timing when the second prescribed vacuum drawing time, which is longer than the prescribed vacuum drawing time, has passed from when the vacuum drawing inside the cavity portion was started; controls the vacuum drawing portion to stop the vacuum drawing inside the cavity portion; acquires the second pressure inside the cavity portion at a timing when the prescribed stoppage time has passed from when the vacuum drawing inside the cavity portion was started; and obtains the pressure increase by subtracting the first pressure from the second pressure. Due to this, it is possible to accurately acquire the ultimate pressure and the pressure increase. Furthermore, by making the prescribed vacuum drawing time when acquiring the pressure increase longer than the prescribed vacuum drawing time when acquiring the ultimate pressure, the first pressure reached according to the prescribed vacuum drawing time used when acquiring the pressure increase can be stabilized, thereby making it possible to reduce the error in the pressure increase.

(13) The casting mold includes the molten metal holding portion for holding molten metal to be injected into the cavity portion, and the plug member that is inserted into the molten metal holding portion to cause air-tight sealing of the inside of the molten metal holding portion from the outside; in the acquisition of the ultimate pressure, the control section corrects the ultimate pressure based on a difference in internal volume of the molten metal holding portion, the internal volume communicating with the cavity portion, between a timing at which the plug member has been inserted into the molten metal holding portion and a timing at which injection of molten metal into the cavity portion is started without the plug member being inserted into the molten metal holding portion; and in the acquisition of the pressure increase, the control section corrects the pressure increase based on the difference in internal volume. Due to this, it is possible to acquire the ultimate pressure and pressure increase occurring at the time of casting with high accuracy, without actually performing the casting.

(14) The casting mold includes: the through-hole that is formed to allow the cavity portion and the outside of the casting mold to communicate with each other and holds the ejector pin for ejecting the cast product from the cavity portion; the second gas flow path that is formed inside the casting mold and has the second end connected to the space between the through-hole and the ejector pin; and the sealing member that seals the region between the second end and the outside, in the space between the through-hole and the ejector pin; the vacuum drawing portion draws a vacuum inside the cavity portion, via both the first gas flow path and the second gas flow path; in the acquisition of the ultimate pressure, the control section: controls the vacuum drawing portion and the shut-off valve to start the vacuum drawing inside the cavity portion via both the first gas flow path and the second gas flow path, with the shut-off valve being in an open state; and acquires the ultimate pressure based on pressure at the third end of the first gas flow path, which is on an opposite side from the first end; and in the acquisition of the pressure increase, the control section: controls the vacuum drawing portion and the shut-off valve to stop the vacuum drawing via the first gas flow path and the second gas flow path, with the shut-off valve being in an open state; and acquires the pressure increase based on pressure at the third end of the first gas flow path with the shut-off valve being in the open state. Due to this, it is possible to accurately acquire the ultimate pressure and pressure increase at the timing when vacuum drawing is performed inside the cavity portion via both the first gas flow path and the second gas flow path.

(15) In the acquisition of the ultimate pressure, the control section acquires the second ultimate pressure at the fourth end of the second gas flow path, which is on an opposite side from the second end, at a timing when the prescribed vacuum drawing time has passed from when the vacuum drawing started; and in the evaluation of the first sealing property, the control section judges the first sealing property to be good when the ultimate pressure is less than or equal to the first threshold value and the second ultimate pressure is less than or equal to the third threshold value, and judges the first sealing property to be poor when the ultimate pressure is greater than the first threshold value or the second ultimate pressure is greater than the third threshold value. Due to this, the first sealing property can be more accurately evaluated by using both the ultimate pressure in the first gas flow path and the second ultimate pressure in the second gas flow path.

What is claim is:

1. An inspection method of a casting device including a casting mold, wherein:

the casting mold includes a cavity portion configured to create a cast product, a first gas flow path that includes a first end connected to the cavity portion, and a shut-off valve configured to shut off the first gas flow path; and the casting device includes a vacuum drawing portion configured to draw a vacuum inside the cavity portion, via the first gas flow path, the inspection method comprising:

acquiring an ultimate pressure inside the cavity portion at a timing when a prescribed vacuum drawing time has passed from when vacuum drawing inside the cavity portion was started;

performing vacuum drawing inside the cavity portion that has been returned to atmospheric pressure, stopping the vacuum drawing after a pressure inside the cavity portion had reached a constant pressure, and acquiring a pressure increase inside the cavity portion, which has occurred during a prescribed stoppage time, at a timing when the prescribed stoppage time has passed from when the vacuum drawing was stopped in a state of the shut-off valve being kept open;

evaluating a first sealing property of the casting device based on the ultimate pressure; and evaluating a second sealing property of the casting device based on the pressure increase.

2. The inspection method of the casting device according to claim 1, wherein:

the evaluating of the first sealing property includes judging the first sealing property to be good when the ultimate pressure is less than or equal to a first threshold value and judging the first sealing property to be poor when the ultimate pressure is greater than the first threshold value.

3. The inspection method of the casting device according to claim 1, wherein:

the evaluating of the second sealing property includes judging the second sealing property to be good when the pressure increase is less than or equal to a second threshold value and judging the second sealing property to be poor when the pressure increase is greater than the second threshold value.

4. The inspection method of the casting device according to claim 1, wherein:

the acquiring of the ultimate pressure includes:

starting the vacuum drawing inside the cavity portion; and acquiring the ultimate pressure inside the cavity portion at a timing when the prescribed vacuum drawing time has passed from when the vacuum drawing inside the cavity portion was started; and the acquiring of the pressure increase includes:

starting the vacuum drawing inside the cavity portion;

acquiring a first pressure inside the cavity portion at a timing when a second prescribed vacuum drawing time, which is longer than the prescribed vacuum drawing time, has passed from when the vacuum drawing inside the cavity portion was started;

stopping the vacuum drawing inside the cavity portion;

acquiring a second pressure inside the cavity portion at a timing when the prescribed stoppage time has passed from when the vacuum drawing inside the cavity portion was stopped; and obtaining the pressure increase by subtracting the first pressure from the second pressure.

5. The inspection method of the casting device according to claim 1, wherein:

the casting mold includes:

a through-hole that is formed to allow the cavity portion and an outside of the casting mold to communicate with each other and is configured to hold an ejector pin configured to eject the cast product from the cavity portion;

a second gas flow path that is formed inside the casting mold and includes a second end connected to a space between the through-hole and the ejector pin; and a sealing member configured to seal a region between the second end of the second gas flow path and an outside, in a space between the through-hole and the ejector pin;

the vacuum drawing portion draws a vacuum inside the cavity portion, via both the first gas flow path and the second gas flow path;

the acquiring of the ultimate pressure includes:

starting the vacuum drawing inside the cavity portion via both the first gas flow path and the second gas flow path, with the shut-off valve being in an open state; and acquiring the ultimate pressure based on pressure at a third end of the first gas flow path, which is on an opposite side from the first end; and the acquiring of the pressure increase includes:

stopping the vacuum drawing via the first gas flow path and the second gas flow path, with the shut-off valve being in an open state; and acquiring the pressure increase based on pressure at the third end of the first gas flow path with the shut-off valve being in the open state.

6. The inspection method of the casting device according to claim 5, wherein:

the acquiring of the ultimate pressure includes acquiring a second ultimate pressure at a fourth end of the second gas flow path, which is on an opposite side from the second end, at a timing when the prescribed vacuum drawing time has passed from when the vacuum drawing started; and the evaluating of the first sealing property includes judging the first sealing property to be good when the ultimate pressure is less than or equal to a first threshold value and the second ultimate pressure is less than or equal to a third threshold value, and judging the first sealing property to be poor when the ultimate pressure is greater than the first threshold value or the second ultimate pressure is greater than the third threshold value.

7. An inspection method of a casting device including a casting mold, wherein:

the casting mold includes a cavity portion configured to create a cast product, a first gas flow path that includes a first end connected to the cavity portion, and a shut-off valve configured to shut off the first gas flow path; and the casting device includes a vacuum drawing portion configured to draw a vacuum inside the cavity portion, via the first gas flow path, the inspection method comprising:

acquiring an ultimate pressure inside the cavity portion at a timing when a prescribed vacuum drawing time has passed from when vacuum drawing inside the cavity portion was started;

acquiring a pressure increase inside the cavity portion, which has occurred during a prescribed stoppage time, at a timing when the prescribed stoppage time has passed from when, after vacuum drawing inside the cavity portion, the vacuum drawing was stopped in a state of the shut-off valve being kept open;

evaluating a first sealing property of the casting device based on the ultimate pressure; and evaluating a second sealing property of the casting device based on the pressure increase, wherein:

the casting mold includes:

a fixed mold, a sleeve attached to the fixed mold, a plunger arranged inside the sleeve and having a plunger tip at a tip end, and a molten metal holding portion formed in the fixed mold, connecting the sleeve to the cavity portion, and configured to hold molten metal to be injected into the cavity portion;

the inspection method comprises sealing an inside of the cavity portion from outside by inserting a plug member for air-tight sealing into the molten metal holding portion between the plunger tip and the cavity portion, performed before the acquiring of the ultimate pressure;

the acquiring of the ultimate pressure includes correcting the ultimate pressure based on a difference in internal volume of the molten metal holding portion, the internal volume communicating with the cavity portion, between a timing at which the plug member has been inserted into the molten metal holding portion and a timing at which injection of molten metal into the cavity portion is started without the plug member being inserted into the molten metal holding portion; and the acquiring of the pressure increase includes correcting the pressure increase based on the difference in internal volume.

8. The inspection method of the casting device according to claim 7, wherein:

the sealing of the inside of the cavity portion from the outside includes, after the plug member has been inserted into the molten metal holding portion, drawing a vacuum inside the cavity portion for a time shorter than the prescribed vacuum drawing time, and thereby causing the plug member to abut against a bottom of the molten metal holding portion.

* * * * *